United States Patent [19]

Edgmon

[11] Patent Number: 4,603,741

[45] Date of Patent: Aug. 5, 1986

[54] WEIGHT ACTUATED TUBING VALVE

[75] Inventor: John W. Edgmon, Conroe, Tex.

[73] Assignee: Hughes Tool Company, Houston, Tex.

[21] Appl. No.: 703,585

[22] Filed: Feb. 19, 1985

[51] Int. Cl.[4] ..... E21B 34/06

[52] U.S. Cl. ..... 166/369; 166/373; 166/317; 166/318

[58] Field of Search ..... 166/187, 194, 212, 239, 166/317, 318, 339, 369, 373

[56] References Cited

U.S. PATENT DOCUMENTS

| | | | |
|---|---|---|---|
| 2,586,015 | 2/1952 | Edwards | 166/194 |
| 2,928,470 | 3/1960 | Baker | 166/194 |
| 3,025,913 | 3/1962 | Sizer | 166/212 |
| 3,706,344 | 12/1972 | Vann | 166/297 |
| 4,372,384 | 2/1983 | Kinney | 166/278 |

*Primary Examiner*—James A. Leppink
*Assistant Examiner*—William P. Neuder
*Attorney, Agent, or Firm*—Charles D. Gunter, Jr.

[57] ABSTRACT

A weight actuated tubing valve is shown which is incorporated within a tubing sub, installed within a string of tubing extending from the well surface within a well bore. The tubing valve includes an outer cylindrical sidewall and an inner mandrel which is spaced apart from the sidewall to define an annular space. The outer sidewall and inner mandrel are each provided with one or more openings for communicating the interior bore of the tubing string with the well annulus. A sliding sleeve is located within the annular space and is movable between a first position which closes off the mandrel opening from the annular space to a second position in which the mandrel opening communicates with the annular space, and through the sidewall opening with the exterior of the tubing string. A fluid chamber initially contains a fluid for supporting the sliding valve within the annular space in the first position. A hollow pin initially contains the fluid within the annular space but is sheared by dropping a weight within the tubing string, whereby the support fluid is released from the annular space to allow the sleeve to move to the second, open position.

2 Claims, 4 Drawing Figures

WEIGHT ACTUATED TUBING VALVE

BACKGROUND OF THE INVENTION

1. Field of the Invention

The present invention relates to valves of the type used to communicate the annulus of a well with the interior bore of a well tubing string and, specifically, to a tubing conveyed production valve which is opened to produce well fluids by dropping a weight down the interior of the tubing string from the surface.

2. Description of the Prior Art

As oil and gas well bores are drilled, the integrity of the borehole is preserved, usually by cementing a casing or liner in place in the borehole. The casing or liner is a metal, cylindrical conduit which must be punctured or perforated over the desired interval in order to produce well bore fluids once drilling is complete. A perforating gun which utilizes some form of fired projectile and an explosive charge is used to perforate the casing or liner to begin production from the well. Prior perforating techniques have either utilized tools which were run on a wireline or cable or were tubing conveyed devices which were run on a tubing string to the desired depth in the well bore. The terms "tubing","casing", and "pipe" may be used interchangeably in this discussion to describe metal cylindrical conduits of the type used in the well bore operations which follow.

In tubing conveyed perforating systems, the tubing can be run into position, a packer set to seal off the well bore, and surface wellhead equipment can be installed. The packer setting can be checked by circulating fluid under pressure through the well annulus or through the well tubing string. Once the topside work is completed and tested for safety, the perforating gun can be fired to bring in the well. A tubing valve can also be incorporated in the tubing string which is opened by dropping a weight, such as a cylindrical bar, down the interior of the tubing string. In certain perforating systems, the dropped bar is also utilized to fire a percussion detonator to perforate the casing and bring in the well.

Prior weight actuated production valves of the type described had an outer cylindrical sidewall with an opening therein and an inner mandrel, also containing an opening, which was spaced apart from the outer cylindrical sidewall to provide an annular chamber. A sliding sleeve valve was located within the annular chamber. The annular chamber was at atmospheric pressure and was initially sealed off from the interior of the tubing string by a frangible pin having a hollow interior.

Once the valve was run into position, a bar was dropped from the well surface to sever the frangible pin. It was then necessary to pressure up the interior of the tubing string from the surface. The tubing pressure was communicated through the opening left by the severed pin and acted upon the sliding sleeve in piston-like fashion to move the sliding sleeve upwardly to an open position which communicated the well annulus, annular chamber, and interior of the tubing string.

Certain problems existed with prior art devices of the type described. For instance, it is often desirable to maintain the tubing interior unpressured, or at a lower pressure than the surrounding formation so that the formation would not be over burdened during the perforating operation. Because it was necessary to pressurize the interior of the tubing string, the prior devices could present possible risks to operating personnel. In addition, it was desirable to provide a device which would fail in the open position rather than the closed position if difficulty was encountered during the perforating operation.

SUMMARY OF THE INVENTION

The weight actuated tubing valve of the invention includes a tubing sub which has upper and lower connecting ends for installation within a string of tubing extending from the surface within a wellbore. The tubing sub has an outer cylindrical sidewall with at least one opening therein and an inner mandrel spaced apart from the outer cylindrical sidewall to thereby create an annular space between the exterior of the inner mandrel and the interior of the outer cylindrical sidewall. The inner mandrel has at least one opening therein which communicates the interior of the tubing string with the annular space. A sliding sleeve is located within the annular space and is movable between a first position which closes off the mandrel opening from the annular space and a second position in which the mandrel opening communicates with the annular space, and through the sidewall opening with the exterior of the tubing string. A fluid chamber initially contains a substantially incompressible fluid for supporting the sliding sleeve within the annular space in the first position. Frangible means initially contain the fluid within the annular space and include a frangible portion which extends within the interior of the tubing string in the path of a weight dropped through the tubing string, whereby a weight dropped within the tubing string severs the frangible portion to release the fluid from the annular space and allow the sleeve to move to the second position.

Additional objects, features and advantages will be apparent in the written description which follows.

DETAILED DESCRIPTION OF THE INVENTION

Figure 1A:
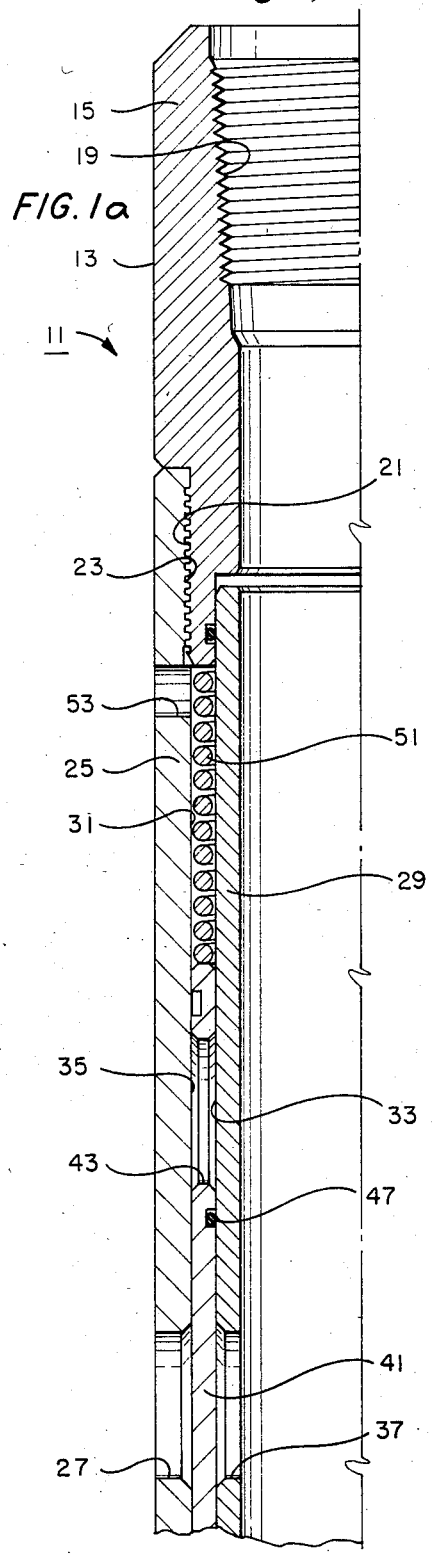
FIGS. 1*a* and 1*b* are successive downward continuations showing side, partial cross-sectional views of a tubing sub containing a weight actuated tubing valve of the invention in the closed position.
Figure 1B:
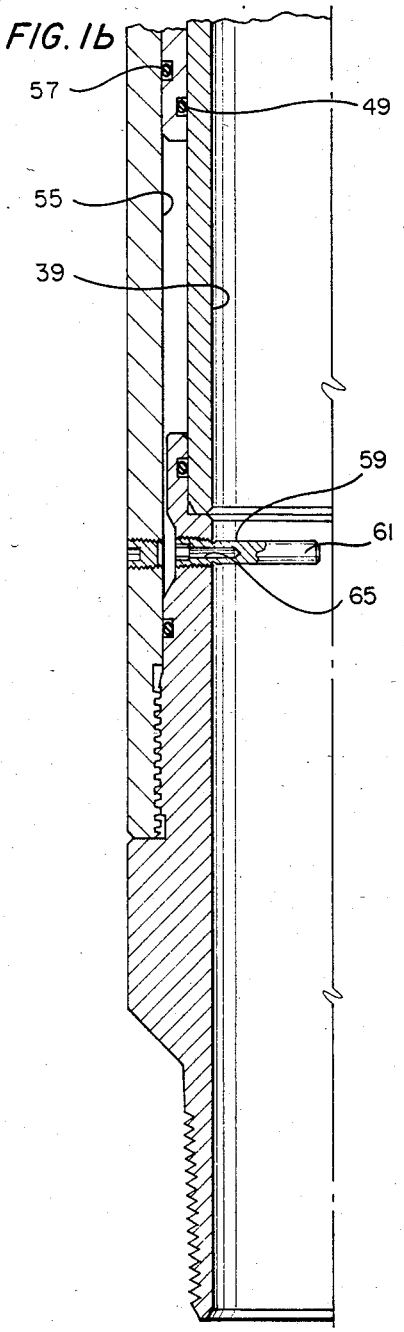

FIGS. 1*a* and 1*b* show a weight actuated tubing valve, designed generally as 11, of the invention. The tubing valve 11 includes a tubing sub 13 having upper and lower connecting ends 15, 17 for installation within a string of well tubing extending from the surface within a wellbore. Connecting end 15 includes an internally threaded portion 19 for connection with a mating cylindrical tubing member in the tubing string, and has an outer threaded surface 21 for engaging the mating internally threaded surface 23 of an outer cylindrical sidewall 25. Sidewall 25 includes at least one opening 27 therein which communicates with the well annulus.

The tubing valve 11 also includes an inner mandrel 29 which is spaced-apart from the outer cylindrical sidewall 25 to thereby create an annular space 31 between the exterior 33 of the inner mandrel 29 and the interior 35 of the outer cylindrical sidewall 25. The inner mandrel 29 has at least one opening 37 therein which communicates the interior bore 39 of the tubing string with the annular space 31.

A sliding sleeve 41 is located within the annular space 31. Sleeve 41 is generally cylindrically shaped and includes an opening 43 at the upper extent thereof. A pair of O-ring seals 47, 49 span the mandrel opening 37 to seal off the interior of the tubing string 39 from the opening 27 in the cylindrical sidewall. A biasing means such as coil spring 51 is located in the annular space 31 above the sliding sleeve 41. One or more ports 53 can be provided in the cylindrical sidewall 25 whereby annulus pressure communicates with the annular space above the sliding sleeve 41.

A fluid chamber located below the sliding sleeve 41 in the annular space 31 initially contains a substantially incompressible fluid such as an oil for supporting the sliding sleeve 41 within the annular space in a first, closed position shown in FIGS. 1*a* and 1*b*. An interior O-ring seal 49 as well as exterior O-ring seal 57 on the sliding sleeve 41 contain the fluid at the upper end of chamber 55.

Figure 2A:
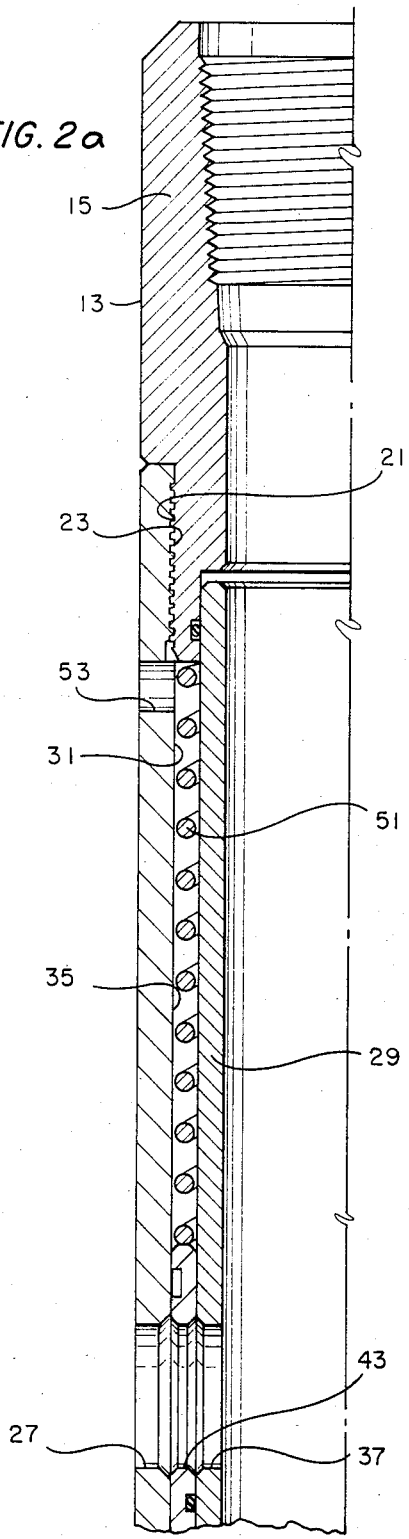
FIGS. 2*a* and 2*b* are successive downward continuations showing side, partial cross-sectional views similar to FIG. 1, showing the weight actuated tubing valve in the open position.
Figure 2B:
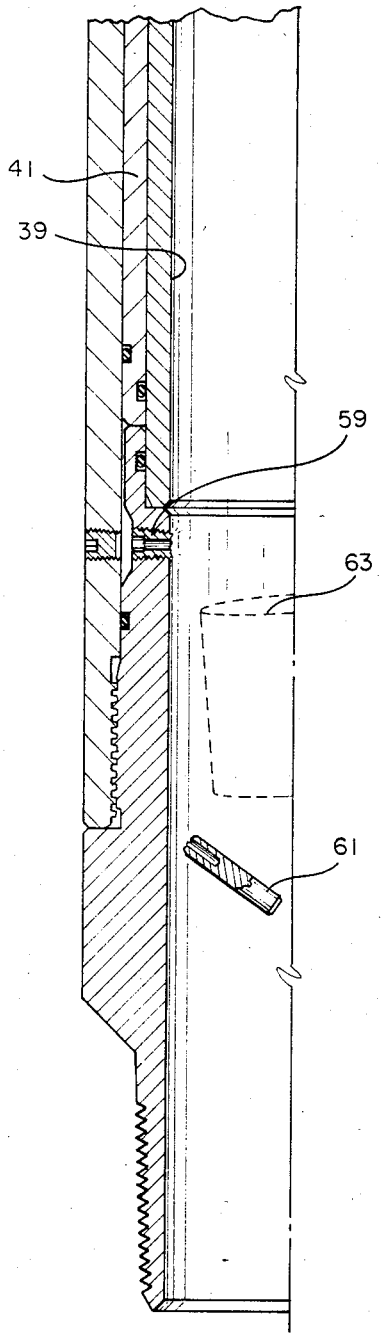

A frangible means such as a hollow pin 59 is provided at the lower end of the fluid chamber 55 for initially containing the fluid within the annular space. The hollow pin 59 includes a frangible portion 61 which extends within the interior 39 of the tubing string in the path of a weight dropped through the tubing string, such as cylindrical bar 63 (FIG. 2*b*). Hollow pin 59 has an internal passageway 65 which communicates with the fluid chamber 55, whereby the bar 63 being dropped within the tubing string severs the frangible portion to release fluid from within the chamber 55 and allow the sleeve to move to a second, open position shown in FIGS. 2*a* and 2*b*.

The operation of the tubing valve of the invention will now be described. The tubing valve 11 is run into position on a well tubing string with the sliding sleeve in the position shown in FIGS. 1*a* and 1*b* and with the frangible pin 59 initially sealing the fluid within chamber 55. Once the appropriate depth is reached, a conventional packer carried at another point on the tubing string would be set to seal off the annular region below the packer which is to be produced from the annular region above the packer. A weight, such as bar 63, would then be dropped through the tubing string from the well surface. Bar 63 severs the hollow pin 59, allowing the fluid within chamber 55 to leave the sealed chamber and enter the interior 39 of the tubing string. The biasing force of spring 51 causes the sliding sleeve 41 to move from the first, closed position shown in FIGS. 1*a* and 1*b* to the second, open position shown in FIGS. 2*a* and 2*b*.

It should also be noted that well annular pressure communicates through the port 53 and opening 27 with the upper end of the sliding sleeve 41 and that portion of the sleeve above seals 49, 57. Where the dropped weight 63 is also utilized as the precussion detonator for a tubing conveyed perforating gun of the known type, the resulting formation pressure of the produced fluids acts upon the sliding sleeve 41, in addition to the spring force, to move the sliding sleeve to the open position. It should be noted that the interior bore 39 of the tubing string can be completely dry and unpressured prior to opening the sliding sleeve 41. It is not necessary to pressure-up the interior of the tubing bore in order to actuate the valve.

An invention has been provided with several advantages. The weight actuated valve of the invention can be actuated without pressuring the interior of the tubing bore and thereby burdening the producing formation. Operational safety is enhanced because of the elimination of high tubing pressures. The valve of the invention is fail-safe, in that the device will fail in the open position, if difficulties are encountered.

While the invention has been shown in only one of its forms, it is not thus limited but is susceptible to various changes and modification without departing from the spirit thereof.

I claim:

1. A method of producing well fluids from a well annulus through a tubing conveyed production valve, comprising the steps of:

connecting a tubing sub within a well tubing string, the tubing sub having an outer cylindrical sidewall with at least one opening therein, and having an inner mandrel spaced-apart from said outer cylindrical sidewall to thereby create an annular space between the exterior of said inner mandrel and the interior of said outer cylindrical sidewall, said inner mandrel having at least one opening therein which communicates the interior of said tubing string with said annular space;

positioning a sliding sleeve within said annular space in a first position which closes off said mandrel opening from said annular space;

supporting said sliding sleeve in said first position by filling said annular space below said sliding sleeve with a substantially incompressible fluid;

initially sealing said fluid within said annular space by means of a frangible member which seals off said annular space from said tubing sub interior, the frangible member being positioned to extend within said tubing sub interior in the path of an object dropped through said tubing string;

running the well tubing string containing the production valve into a desired well bore location with said production valve in said first, closed position;

dropping a weight from the well surface, down said tubing interior to sever said frangible member, thereby releasing said support fluid and opening said production valve; and wherein said tubing string interior is unpressured at the time said valve is opened.

2. A weight actuated, tubing conveyed, production valve, comprising:

a tubing sub having upper and lower connecting ends for installation within a string of tubing extending from the surface within a well bore, said tubing sub having an outer cylindrical sidewall with at least one opening therein;

an inner mandrel spaced apart from said outer cylindrical sidewall to thereby create an annular space between the exterior of said inner mandrel and the interior of said outer cylindrical sidewall, said inner mandrel having at least one opening therein which communicates the interior of said tubing string with said annular space;

a sliding sleeve located within said annular space having at least one opening therein for communicating said tubing interior, annular space and well annulus, said sleeve being movable between a first position which closes off said mandrel opening from said annular space and a second position in which mandrel opening communicates with said annular space, and through said sidewall opening with the exterior of said tubing string;

a coil spring located in said annular space above said sliding sleeve for initially biasing said sliding sleeve toward said open position;

an annular fluid chamber located below said sliding sleeve and initially containing a substantially incompressible fluid for supporting said sliding sleeve within said annular space in said first position;

frangible means initially containing said fluid within said annular space, said frangible means including a frangible portion which extends within the interior of said tubing string in the path of a weight dropped through said tubing string, whereby a weight dropped within said tubing string severs said frangible portion to release said fluid from said annular space and allow said sleeve to move to said second position; and port means for communicating said well annulus with said annular space above said sliding valve, to thereby provide annulus pressure for moving said sliding valve to said open position when said support fluid is released.

* * * * *